US009329538B2

(12) United States Patent
Koda et al.

(10) Patent No.: US 9,329,538 B2
(45) Date of Patent: May 3, 2016

(54) FIXING DEVICE AND IMAGE FORMING APPARATUS

(71) Applicant: KYOCERA Document Solutions Inc., Osaka (JP)

(72) Inventors: Shoji Koda, Osaka (JP); Seiji Okada, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/499,533

(22) Filed: Sep. 29, 2014

(65) Prior Publication Data

US 2015/0093136 A1 Apr. 2, 2015

(30) Foreign Application Priority Data

Sep. 30, 2013 (JP) ..... 2013-204640

(51) Int. Cl.
*G03G 15/20* (2006.01)

(52) U.S. Cl.
CPC ..... *G03G 15/2039* (2013.01); *G03G 15/2064* (2013.01); *G03G 2215/2029* (2013.01); *G03G 2215/2045* (2013.01)

(58) Field of Classification Search
USPC ..... 399/68, 69, 70
See application file for complete search history.

(56) References Cited

U.S. PATENT DOCUMENTS

| | | | | |
|---|---|---|---|---|
| 5,819,149 | A * | 10/1998 | Watanabe et al. | 399/330 |
| 7,941,063 | B2 * | 5/2011 | Suzuki et al. | 399/44 |
| 8,180,240 | B2 * | 5/2012 | Cao | G03G 15/2039 399/70 |
| 8,229,312 | B2 * | 7/2012 | Shinyama | 399/68 |
| 9,020,385 | B2 * | 4/2015 | Kajita et al. | 399/68 |

FOREIGN PATENT DOCUMENTS

JP H06-043783 2/1994

* cited by examiner

*Primary Examiner* — Clayton E LaBalle
*Assistant Examiner* — Warren K Fenwick

(57) ABSTRACT

A fixing device includes a heat rotor with a heat source, a pressure rotor forming a fixing nip with the heat rotor and expandable by heat given from the heat rotor, a drive section configured to rotate the pressure rotor, a control section configured to control the drive section, thus controlling a rotational speed of the pressure rotor, and a heat quantity detecting section configured to determine a quantity of heat from the heat rotor to the pressure rotor since a reference time point when the fixing device transitions from outage to operating state. The control section performs a first rotation control for allowing the pressure rotor to rotate at a first rotational speed after the heat quantity detecting section detects the quantity of heat has reached a predetermined specified value and at a second rotational speed before the heat quantity detecting section detects the specified value has been reached.

4 Claims, 11 Drawing Sheets

Fig.6

| ELAPSED TIME | REFERENCE TIME POINT ~60sec | 60sec ~ 120sec | 120sec ~ 180sec | 180sec ~ 240sec | 240sec ~ 300sec | 300sec ~ 420sec | 420sec ~ 600sec |
|---|---|---|---|---|---|---|---|
| RATE OF SPEED INCREASE OF PRESSURE ROLLER (SURFACE TEMPERATURE OF 45℃ OR BELOW ) | 2. 28% | 1. 85% | 1. 43% | 1. 27% | 0. 74% | 0. 60% | 0. 60% |
| RATE OF SPEED INCREASE OF PRESSURE ROLLER (SURFACE TEMPERATUER OF 46℃-70℃) | 1. 85% | 1. 43% | 1. 27% | 0. 74% | 0. 60% | 0. 60% | 0. 60% |

Fig.8

EMVIRONMENT-DEPENDENT CORRECTION TABLE

| CONDITION | SPEED CORRECTION RATE |
|---|---|
| AMBIENT TEMPERATURE OF BELOW 15℃ | 0. 30% |
| AMBIENT HUMIDITY OF ABOVE 60% | −0. 30% |
| AMBIENT TEMPERATURE OF 15℃ OR ABOVE AND AMBIENT HUMIDITY OF 60% OR BELOW | 0. 00% |

FIXING DEVICE AND IMAGE FORMING APPARATUS

INCORPORATION BY REFERENCE

This application claims priority to Japanese Patent Application No. 2013-204640 filed on Sep. 30, 2013, the entire contents of which are incorporated by reference herein.

BACKGROUND

The present disclosure relates to fixing devices configured to fix a toner image on a sheet and image forming apparatuses to which the fixing devices are applied.

A general fixing device for an image forming apparatus includes a fixing nip formed by a fixing roller and a pressure roller pressed against each other. A sheet to which an unfixed toner image is transferred is nipped by the fixing nip and conveyed downstream by the rotating fixing roller and pressure roller. While the sheet passes through the fixing nip, pressure and heat are applied to the sheet, so that the toner image is fixed on the sheet. Generally, the fixing roller is equipped with a heat source, such as an electric heater or an IH heater, capable of generating heat necessary for toner fixation. This heat is given through the fixing nip to the pressure roller. The pressure roller is driven into rotation and the fixing roller rotates to follow the rotation of the pressure roller.

In order to form an image of good quality, it is necessary to maintain the conveyance speed of the sheet passing through the fixing nip constant. However, the sheet conveyance characteristics at the fixing nip varies depending upon factors associated with changes in roller temperature, such as changes in roller diameter. As a solution to this problem, there is known a fixing device configured to detect the surface temperature of the roller using a temperature sensor and control the rotational speed of the roller by feedback based on the detected temperature.

SUMMARY

A technique improved over the above technique is herein proposed as one aspect of the present disclosure.

A fixing device according to an aspect of the present disclosure includes a heat rotor, a pressure rotor, a drive section, a control section, and a heat quantity detecting section.

The heat rotor is equipped with a heat source.

The pressure rotor is pressed against the heat rotor to form a fixing nip and is expandable by heat given from the heat rotor.

The drive section is configured to drive the pressure rotor into rotation.

The control section is configured to control the drive section and thus control a rotational speed of the pressure rotor.

The heat quantity detecting section is configured to determine a quantity of heat given from the heat rotor to the pressure rotor.

The control section is configured to perform a first rotation control so that after the heat quantity detecting section detects that a predetermined specified quantity of heat has been given from the heat rotor to the pressure rotor since a reference time point when the fixing device has transitioned from an outage state to an operating state, the control section allows the pressure rotor to rotate at a predetermined first rotational speed and that before the heat quantity detecting section detects that the specified quantity of heat has been given to the pressure rotor, the control section allows the pressure rotor to rotate at a second rotational speed obtained by correcting the first rotational speed according to the quantity of heat determined by the heat quantity detecting section.

Furthermore, an image forming apparatus according to another aspect of the present disclosure includes an image forming section and the aforementioned fixing device.

BRIEF DESCRIPTION OF THE DRAWINGS

FIG. 6 is a rotational speed control table for use in controlling the rotational speed of a pressure roller.

FIG. 8 is a table for use in correcting the rotational speed depending upon the ambient temperature and humidity.

DETAILED DESCRIPTION

Figure 1:
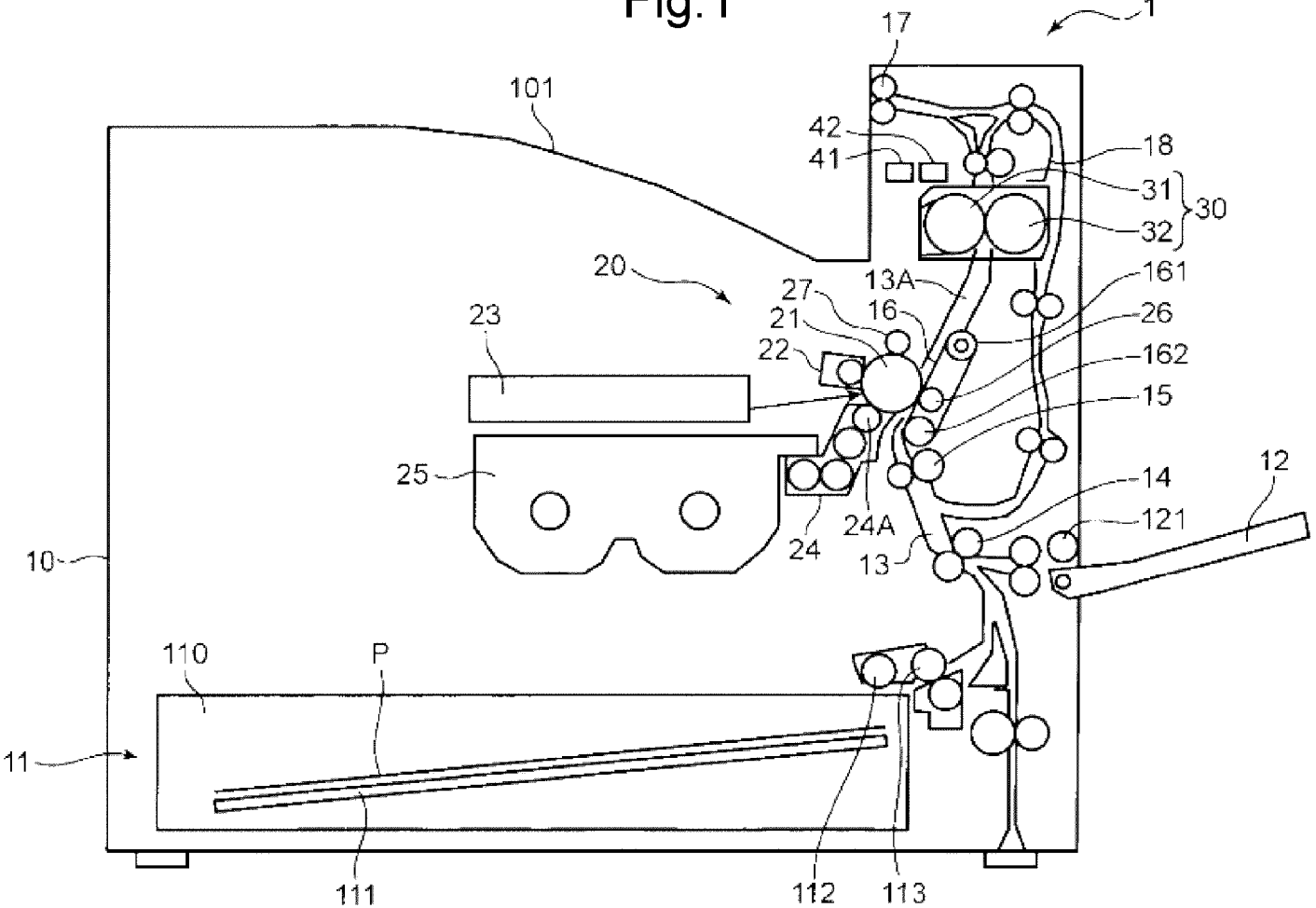
FIG. 1 is a schematic cross-sectional view showing a general structure of an image forming apparatus according to one embodiment of the present disclosure.

Hereinafter, a detailed description will be given of an embodiment of the present disclosure with reference to the drawings. FIG. 1 is a cross-sectional view showing an internal structure of an image forming apparatus 1 according to the embodiment of the present disclosure. In this figure, a black-and-white printer is illustrated as an example of the image forming apparatus 1. The image forming apparatus 1 includes a box-shaped body housing 10, a sheet feed unit 11 accommodated in the body housing 10, an image forming unit 20 (image forming section), and a fixing unit 30 (fixing device). An output tray 101 is formed on the top surface of the body housing 10 and configured so that a printed sheet is discharged thereon.

The sheet feed unit 11 includes a sheet feed cassette 110 capable of containing a stack of sheets P, a pick-up roller 112, and a sheet feed roller 113. The pick-up roller 112 and the sheet feed roller 113 are configured to feed out the sheets P in the sheet feed cassette 110 sheet by sheet. The sheets P in the sheet feed cassette 110 are set on a lift plate 111 and lifted up by the lift plate 111 so that their leading ends in a direction of conveyance can come into contact with the pick-up roller 112. Furthermore, a manual feed tray 12 for manual feed of sheets is provided at a sidewall of the body housing 10. The sheet placed on the manual feed tray 12 can be sent forward by a manual feed roller 121.

In the interior of the body housing 10, a sheet conveyance path 13 extending in a vertical direction is continued to the downstream side of the sheet feed unit 11 in the direction of conveyance of the sheet. The sheet conveyance path 13 is a conveyance path passing through the image forming unit 20 and the fixing unit 30 and reaching a sheet output port facing the output tray 101. Upstream of the image forming unit 20 in the sheet conveyance path 13, an intermediate roller pair 14 and a registration roller pair 15 are arranged. The intermediate roller pair 14 conveys the sheet and a registration roller pair 15 temporarily stops the sheet and then sends it toward the image forming unit 20 with a predetermined timing. Furthermore, in the vicinity of the sheet output port, an output roller pair 17 is disposed to send out the sheet from the interior of the body housing 10 to the output tray 101. In addition, a reverse conveyance path 18 for use to convey the sheet backward during double-sided printing is disposed substantially in parallel with the sheet conveyance path 13.

The image forming unit 20 is configured to transfer a toner image to the sheet. The image forming unit 20 includes a photosensitive drum 21, an electric charger 22, an exposure device 23, a developing device 24, a toner container 25, a transfer roller 26, a conveying belt 16, and a cleaning device 27. The electric charger 22, the exposure device 23, the developing device 24, the toner container 25, the transfer roller 26, the conveying belt 16, and the cleaning device 27 are arranged around the photosensitive drum 21.

The photosensitive drum 21 is capable of rotating about its axis and has a peripheral surface on which an electrostatic latent image and a toner image can be formed. The electric charger 22 is configured to uniformly charge the peripheral surface of the photosensitive drum 21. The exposure device 23 is configured to irradiate the peripheral surface of the photosensitive drum 21 with laser light for the purpose of forming an electrostatic latent image on the peripheral surface of the photosensitive drum 21. The developing device 24 includes a developing roller 24A configured to supply toner to the peripheral surface of the photosensitive drum 21 for the purpose of developing the electrostatic latent image formed on the photosensitive drum 21. The toner is supplied from the toner container 25 to the developing device 24. The transfer roller 26 forms a transfer nip together with the photosensitive drum 21 with the conveying belt 16 in between and is configured to transfer the toner image on the photosensitive drum 21 to the sheet. The conveying belt 16 is an endless belt configured to carry the sheet P on its surface and convey it to the transfer nip and is mounted around a drive roller 161 and a tension roller 162. The cleaning device 27 is configured to clean the peripheral surface of the photosensitive drum 21 after the toner image has been transferred therefrom.

The fixing unit 30 includes: a fixing roller 31 (heat rotor) equipped with a heat source; and a pressure roller 32 (pressure rotor) pressed against the fixing roller 31 to form a fixing nip with the fixing roller 31. The pressure roller 32 is a thermally expandable roller and is configured to receive heat from the fixing roller 31. The fixing unit 30 is configured to perform fixation processing for fusing the toner image onto the sheet by applying, at the fixing nip, heat and pressure to the sheet on which the toner image has been transferred at the transfer nip.

In the vicinity of the fixing unit 30, an ambient temperature sensor 41 (second temperature sensor) and an ambient humidity sensor 42 (humidity sensor) are disposed. The ambient temperature sensor 41 is configured to measure the ambient temperature of the fixing unit 30. The ambient humidity sensor 42 is configured to measure the ambient humidity of the fixing unit 30.

Figure 2:
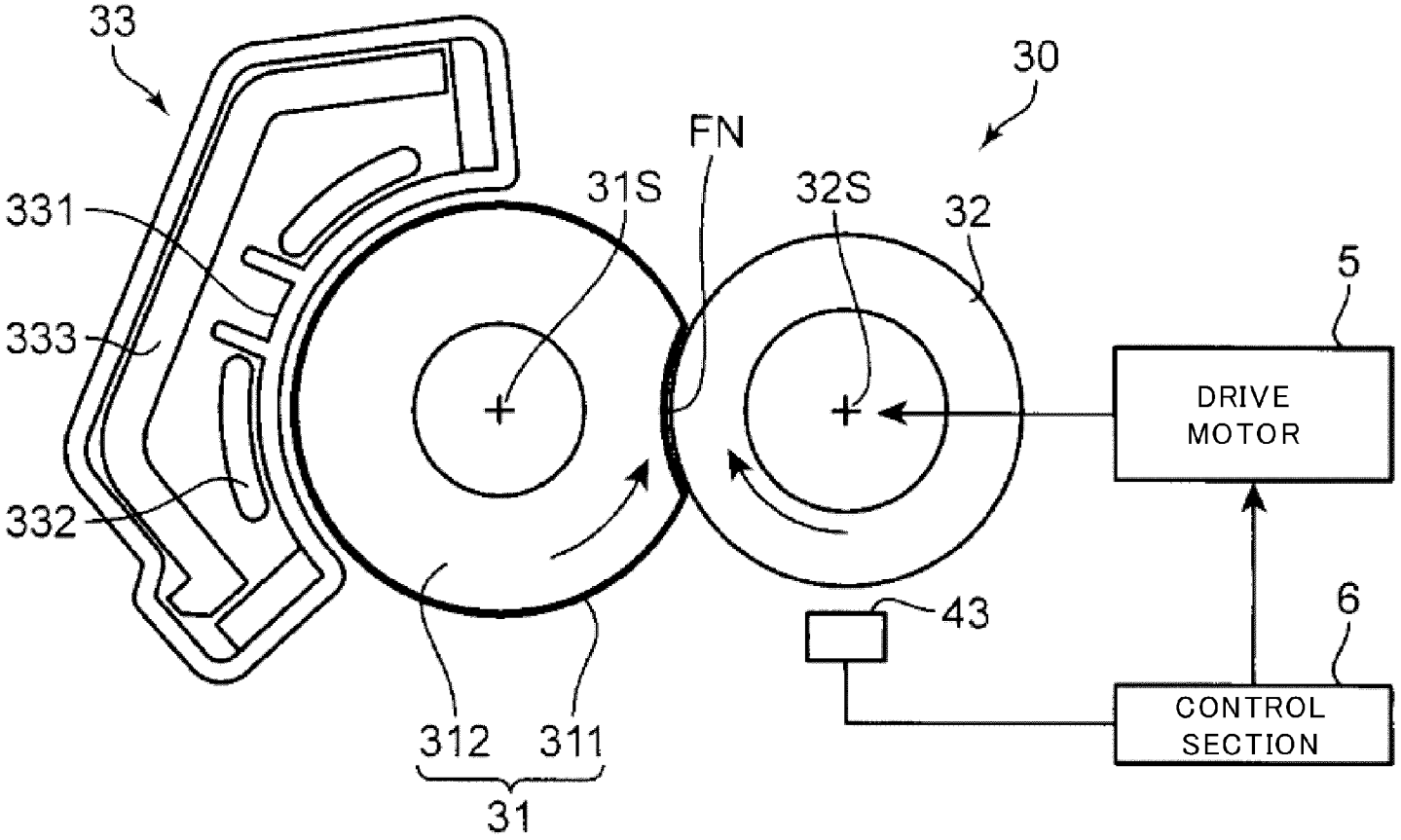
FIG. 2 is a schematic cross-sectional view of a fixing unit assembled in the image forming apparatus.

FIG. 2 is a schematic cross-sectional view showing the structure of the fixing unit 30. The fixing unit 30 includes the aforementioned fixing roller 31 and pressure roller 32, an IH heater 33 configured to heat the fixing roller 31 by induction, a drive motor 5 (drive section), and a control section 6.

The fixing roller 31 has a rotational axis 31S serving as the center of rotation and the pressure roller 32 has a rotational axis 32S extending in parallel with the rotational axis 31S. In this embodiment, the pressure roller 32 is a drive roller and the fixing roller 31 is a driven roller. The drive motor 5 gives a rotary drive force to the rotational axis 32S of the pressure roller 32. By the above rotary drive force, the pressure roller 32 is driven into clockwise rotation about the rotational axis 32S and the fixing roller 31 follows the rotation of the pressure roller 32 to rotate counterclockwise. The control section 6 controls the drive motor 5 and thus controls the rotational speed of the pressure roller 32, that is, the linear speed of the sheet passing through the fixing nip FN.

The fixing roller 31 includes an elastic support roller 312 and a fixing belt 311 (heat rotor) supported on the support roller 312 with a predetermined clearance therefrom. An example that can be given of the support roller 312 is a roller in which an elastic layer made of, for example, silicon sponge, is formed around a cored bar made of metal, for example, SUS, and serving as a shaft center. An example that can be given of the fixing belt 311 is an endless belt with a multilayer structure including a magnetic metal matrix made of, for example, nickel capable of induction heating, an elastic layer made of, for example, silicon rubber, and a surface release layer formed of, for example, fluorine resin.

The pressure roller 32 has higher rigidity than the fixing roller 31. An example that can be given of the pressure roller 32 is a roller in which an elastic layer made of, for example, silicon rubber, is formed around a cored bar made of non-magnetic metal, for example, aluminum, and serving as a shaft center and which includes a surface release layer as an outermost layer. The elastic layer is a thermally expandable layer. The pressure roller 32 is pressed against the fixing roller 31 with a predetermined pressure, so that the peripheral surface of the fixing roller 31 (i.e., the fixing belt 311) abuts, in a deformed state to make a concave curve, against the peripheral surface of the pressure roller 32. This abutment region is the fixing nip FN. The sheet to be subjected to the fixation processing is nipped at the fixing nip FN and thus conveyed by the rotations of the fixing roller 31 and pressure roller 32 about their rotational axes 31S, 32S. While being conveyed at the fixing nip FN, the sheet is subjected to heat and pressure and thus undergoes the fixation processing.

The IH heater 33 is a heat source for use to heat the fixing belt 311 by induction. The IH heater 33 includes a bobbin 331 having a curved shape along the peripheral surface of the fixing roller 31 and disposed facing the fixing roller 31, a coil 332 which is wound around the bobbin 331 and to which a high-frequency voltage for induction heating is to be applied, and a magnetic core 333 forming a magnetic circuit. When a high-frequency voltage is applied to the coil 332, the magnetic circuit passing through the fixing belt 311 is formed, so that an eddy current flows through the magnetic metal matrix. Thus, the fixing belt 311 is charged with heat.

The pressure roller 32 receives heat through the fixing nip FN from the fixing belt 311. In other words, the pressure roller 32 is heated not starting from its roller core but starting from its surface portion toward the roller core. Therefore, in a start-up period of the image forming apparatus 1, such as shortly after it is powered on or shortly after it is returned to an operating mode from a sleep mode or a jam clearing mode, there may arise a state where the surface portion of the roller has already been heated but the roller core and its vicinity have not sufficiently been heated.

A roller temperature sensor 43 (first temperature sensor) is disposed facing the surface of the pressure roller 32. The roller temperature sensor 43 is configured to measure the surface temperature of the pressure roller 32. When the whole of the pressure roller 32 is sufficiently heated, the control section 6 controls the rotational speed of the pressure roller 32 based on the temperature detected by the roller temperature sensor 43. Specifically, in order to maintain the linear speed of the sheet passing through the fixing nip FN constant, the control section 6 estimates a variation of the outer diameter (the degree of thermal expansion) of the pressure roller 32 from the detected temperature and controls the drive motor 5 so that the pressure roller 32 can rotate at a number of rotations appropriate to the estimated outer diameter.

On the other hand, in the aforementioned start-up period, the control section 6 does not perform the control over the rotation of the pressure roller 32 based on the temperature detected by the roller temperature sensor 43 but instead performs a special rotation control (first rotation control). The reason for this is that in the start-up period the temperature detected by the roller temperature sensor 43 does not agree with the actual degree of thermal expansion of the pressure roller 32 and, therefore, even if the control section 6 controls the rotation based on the detected temperature, it cannot control the sheet conveyance speed by feedback as expected. The special rotation control will be described later in detail with reference to FIG. 5 and the subsequent figures.

Figure 3:
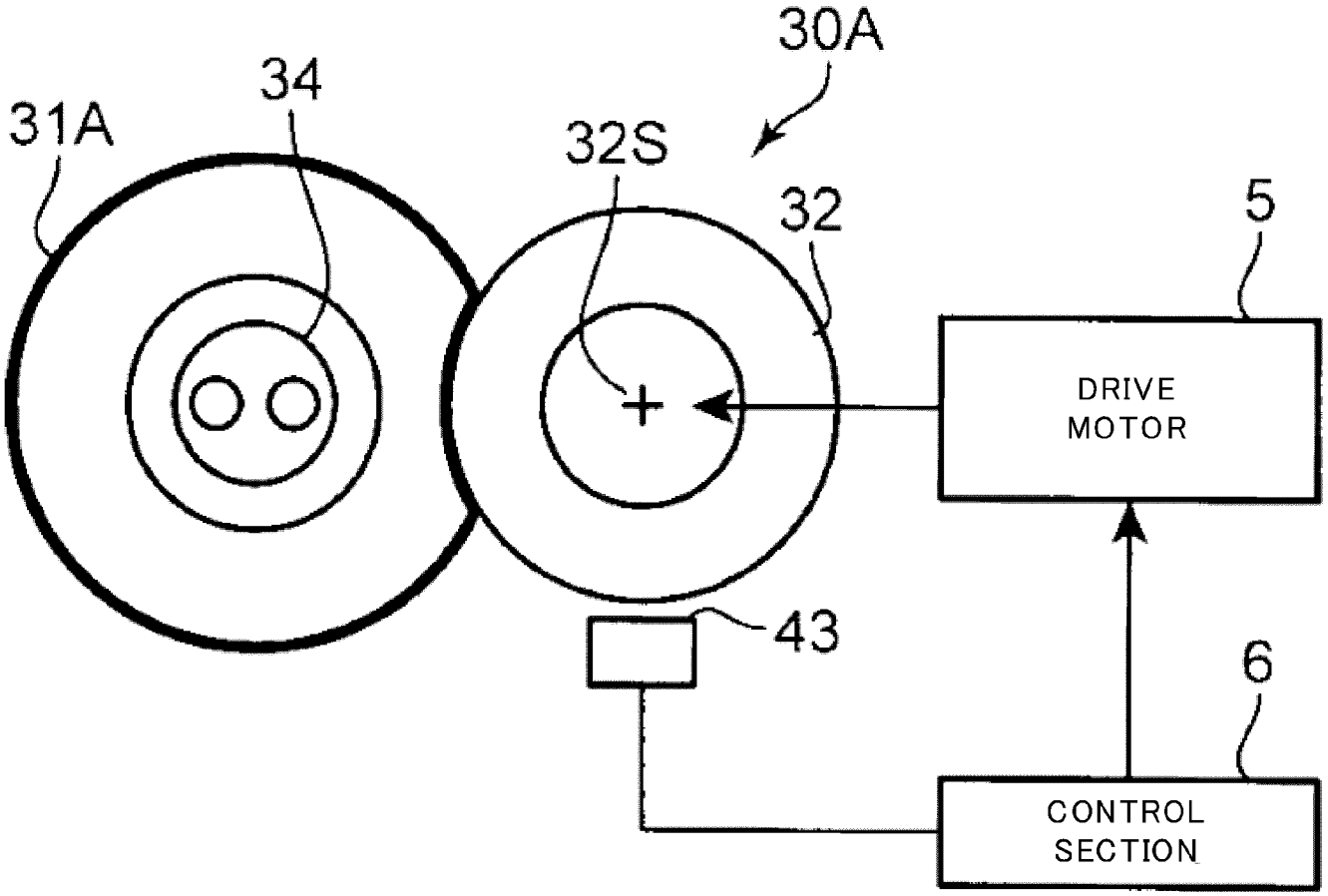
FIG. 3 is a schematic cross-sectional view of a fixing unit according to another embodiment.

FIG. 3 is a schematic cross-sectional view of a fixing unit 30A according to another embodiment. The fixing unit 30A includes a fixing roller 31A (heat rotor) equipped internally with an electric heater 34 as a heat source. An example of the electric heater 34 that can be used is a halogen heater. The electric heater 34 is disposed in the vicinity of the core of the fixing roller 31A and configured to heat the fixing roller 31A from the core inside. The fixing unit 30A further includes a pressure roller 32, a drive motor 5, and a control section 6. These components are the same as those of the fixing unit 30 described previously. This fixing unit 30A, in place of the fixing unit 30 shown in FIG. 2, can be applied to the image forming apparatus 1.

Figure 4:
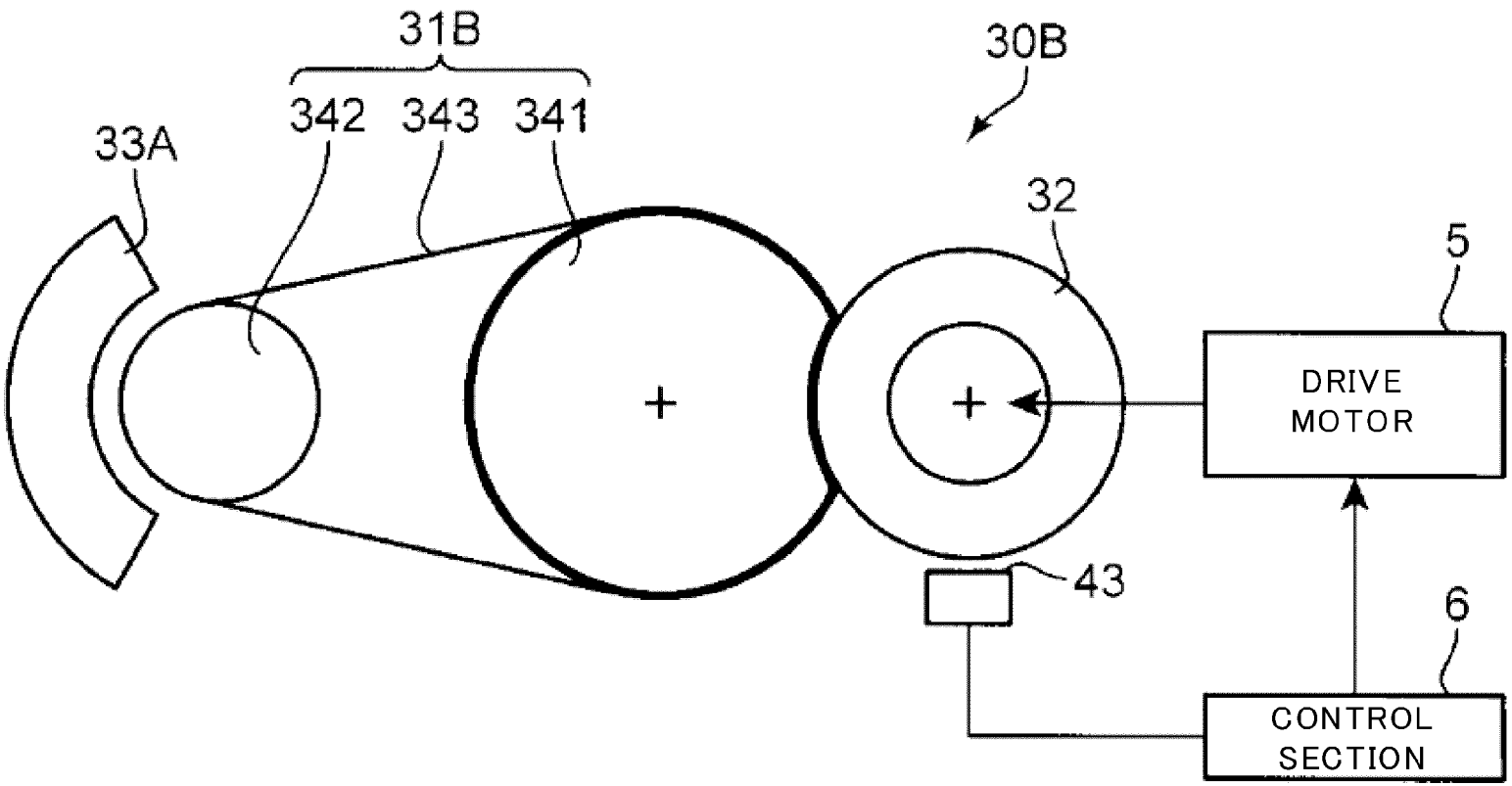
FIG. 4 is a schematic cross-sectional view of a fixing unit according to still another embodiment.

FIG. 4 is a schematic cross-sectional view of a fixing unit 30B according to still another embodiment. The fixing unit 30B includes a fixing roller unit 31B employing an induction heating (IH) technique. The fixing roller unit 31B includes a support roller 341, a heat roller 342, and a fixing belt 343 (heat rotor) mounted around these rollers 341, 342. The support roller 341 and the fixing belt 343 are virtually identical with the support roller 312 and the fixing belt 311, respectively, described in the fixing unit 30 shown in FIG. 2. An IH heater 33A serving as a heat source is disposed facing the heat roller 342. The fixing belt 343 is heated by induction by the IH heater 33A. This fixing unit 30B can also be applied to the image forming apparatus 1. Instead of employing the IH heater 33A, the fixing roller unit 31B may have a structure in which an electric heater is built in the heat roller 342.

Figure 5:
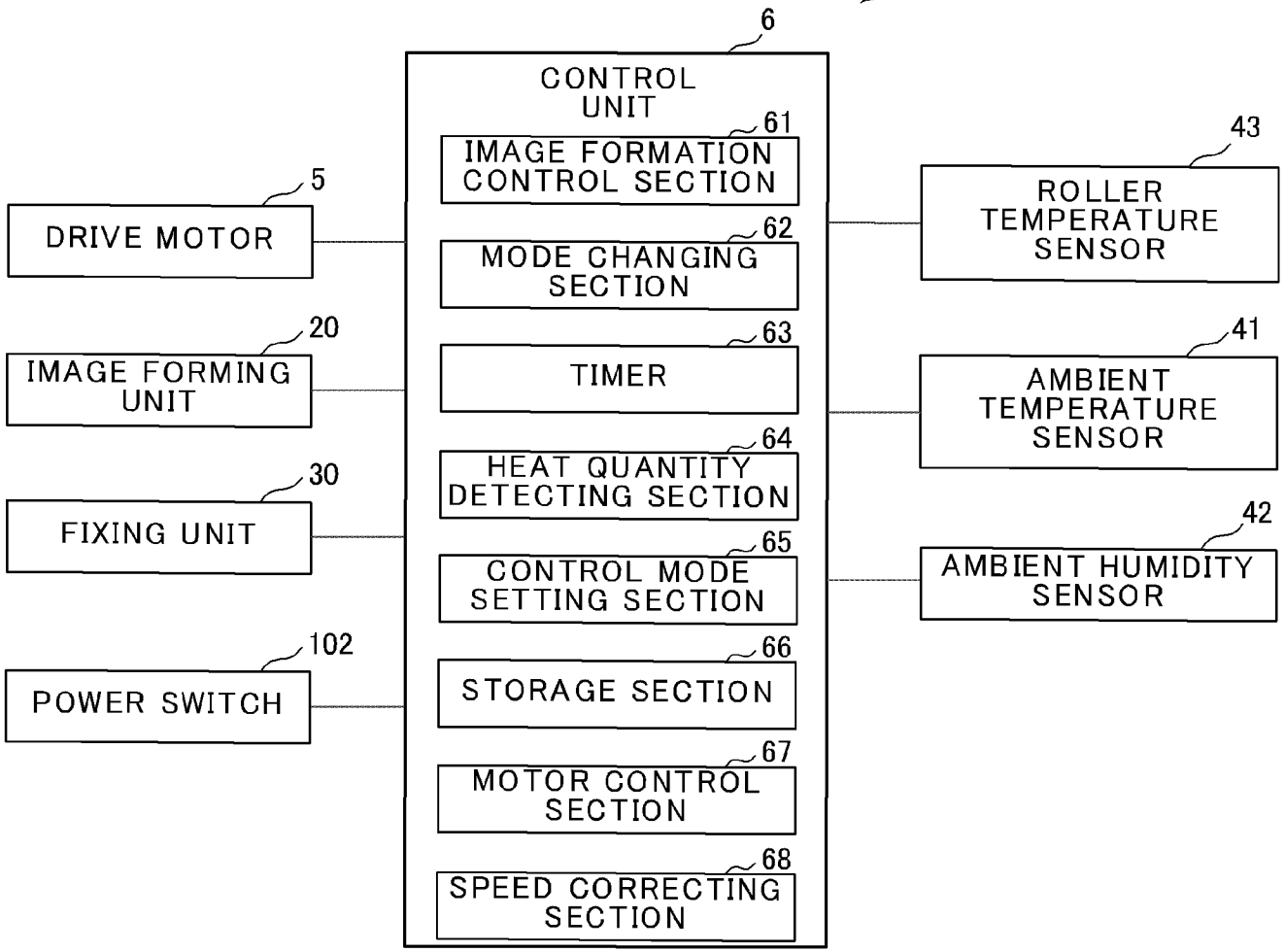
FIG. 5 is a block diagram of the image forming apparatus.

FIG. 5 is a block diagram of the image forming apparatus 1, including the functional configuration of the control section 6. The control section 6 is a microcomputer configured to control various operations of the image forming apparatus 1 and is operable, by reading predetermined programs, to functionally have an image formation control section 61, a mode changing section 62, a timer 63, a heat quantity detecting section 64, a control mode setting section 65, a storage section 66, a motor control section 67, and a speed correcting section 68.

The image formation control section 61 is configured to, when the image forming apparatus 1 receives a print instruction from an external device, such as a personal computer, activate the image forming unit 20 and the fixing unit 30 to perform processing for forming a toner image on a sheet.

The mode changing section 62 controls the change of the operation mode of the image forming apparatus 1 (fixing unit 30). For example, when a power switch 102 of the image forming apparatus 1 is turned ON, the mode changing section 62 sets the operation mode to an image formation mode in which the image formation control section 61 performs image formation processing. For another example, when a state where no operating instruction is given to the image forming apparatus 1 continues for a predetermined period of time, the mode changing section 63 sets the operation mode to the sleep mode. For still another example, when a trouble, such as a sheet jam, occurs, the mode changing section 62 sets the operation mode to a troubleshooting mode.

Furthermore, the mode changing section 62 returns the operation mode to the image formation mode when the operating instruction is given while the sleep mode is going on or when the troubleshooting in the troubleshooting mode is completed. Some of timings with which the mode changing section 62 changes the operation mode are used as a "reference time point" in this embodiment. The timings used as the "reference time point" include the timing of transition from an OFF state of the power switch 102 to the image formation mode and the timing of transition from an outage state, such as the sleep mode or the troubleshooting mode, to the image formation mode (hereinafter, the "reference time point" refers to any one of these timings).

The timer 63 is configured to count the time required for various controls of the control section 6. Particularly in this embodiment, the timer 63 counts the elapsed time since the reference time point.

The heat quantity detecting section 64 is configured to determine the quantity of heat given from the fixing roller 31 to the pressure roller 32 since the reference time point. Examples of the method for determining this quantity of heat includes the following methods (1) to (3).

(1) In the fixing unit 30 (FIG. 2) employing the IH technique, the aforementioned quantity of heat can be determined based on the accumulated value of current having flowed through the coil 332 of the IH heater 33 since the reference time point. The reason for this is that the quantity of heat cumulatively given from the IH heater to the fixing belt 311 is proportional to the sum of current given to operate the IH heater 33 (coil 332). In this case, the heat quantity detecting section 64 acquires the current value and duty cycle of high-frequency current applied to the coil 332 and accumulates the duration of the ON period to determine the sum of current applied to the coil 332. When this sum of current can be determined, the quantity of heat cumulatively given to the fixing belt 311 by induction heating of the IH heater 33 can be estimated. Furthermore, considering the heat-transfer efficiency and so on, the quantity of heat cumulatively given from the fixing belt 311 to the pressure roller 32 can be estimated.

(2) In the fixing unit 30A (FIG. 3) with a built-in electric heater, the aforementioned quantity of heat can be determined based on the ON time of the electric heater 34 since the reference time point. In this case, the heat quantity detecting section 64 determines the quantity of heat produced by the electric heater 34 from the rated power and energized time of the electric heater 34. When this quantity of heat produced can be determined, the quantity of heat given from the fixing roller 31A to the pressure roller 32 can be estimated in consideration of the heat-transfer efficiency and so on.

(3) When heat is applied from the fixing roller 31 (31A, 31B) to the pressure roller 32 with a certain regularity, for example, when the IH heater 33 (electric heater 34) generates a certain quantity of heat to linearly increase the quantity of heat given to the pressure roller 32, the aforementioned quantity of heat can be estimated simply based on the elapsed time since the reference time point. In this case, the heat quantity detecting section 64 uses the time-keeping function of the timer 63 to calculate the quantity of heat given from the fixing roller 31 to the pressure roller 32 based on the count value of the elapsed time since the reference time point. With this configuration, the processing in the heat quantity detecting section 64 can be most simplified.

The control mode setting section 65 acquires, at the reference time point, data on the surface temperature of the pressure roller 32 from the roller temperature sensor 43. Then, depending upon whether or not the acquired temperature is above a predetermined reference temperature, the control mode setting section 65 sets the way of control over the rotation of the pressure roller 32 to either one of (A) a first rotation control and (B) a second rotation control, which will be described below. Here, in the fixing unit 30, the rotational speed of the pressure roller 32 required to give a predetermined sheet conveyance speed (linear speed) during normal operation in which the pressure roller 32 is sufficiently heated is represented by V1 (first rotational speed).

(A) First Rotation Control

Before the heat quantity detecting section 64 detects that a predetermined specified quantity of heat has been given from the fixing roller 31 to the pressure roller 32 since the reference time point, the pressure roller 32 is controlled to rotate at a second rotational speed V2 obtained by correcting the first rotational speed V1 according to the quantity of heat consecutively determined by the heat quantity detecting section 64 (first-stage control A1 of the first rotational control). The specified quantity of heat is a quantity of heat previously calculated as a quantity of heat in which the pressure roller 32, including its core inside, can be sufficiently heated. Thereafter, after the heat quantity detecting section 54 detects that the specified quantity of heat has been given to the pressure roller 32, the pressure roller 32 is controlled to rotate at the first rotational speed V1 (second-stage control A2 of the first rotation control). A feature of this rotation control is that the rotation control does not depend on the surface temperature of the pressure roller 32 but depends on how much quantity of heat the pressure roller 32 has actually received. During the second-stage control A2, a feedback control is performed in which the first rotational speed V1 is finely adjusted based on the surface temperature of the pressure roller 32 detected by the roller temperature sensor 43 so that the predetermined sheet conveyance speed can be maintained.

(B) Second Rotation Control

A feedback control is performed in which the first rotational speed V1 is finely adjusted based on the temperature detected by the roller temperature sensor 43 so that the predetermined sheet conveyance speed can be maintained. That is, this control is the same as the aforementioned second-stage control A2 of the first rotation control.

When at the reference time point the surface temperature of the pressure roller 32 is above the predetermined reference temperature (for example, 70° C.), it can be said that the pressure roller 32 is maintained in a wholly heated condition. In other words, because the temperature of the surface portion likely to lose heat is maintained at the reference temperature or above, it can be estimated that the core inside of the roller is also maintained at the reference temperature or above. An example that can be assumed is the case where an outage time is relatively short, such as completion of jam clearing in a short time. In such a case, the temperature detected by the roller temperature sensor 43 approximately agrees with the actual degree of thermal expansion of the pressure roller 32. Therefore, in such a case, the control mode setting section 65 allows the second rotation control to be performed from the reference time point.

On the other hand, when the surface temperature of the pressure roller 32 is below the reference temperature, it is highly likely that the temperature of the core inside becomes low. In this case, there is a high possibility that a mismatch will occur between the temperature detected by the roller temperature sensor 43 and the degree of thermal expansion of the pressure roller 32. Therefore, in this case, the control mode setting section 65 allows the first rotation control to be performed from the reference time point.

The storage section 66 is configured to store correction values for use in correcting the first rotational speed V1 to obtain the second rotational speed V2. FIG. 6 is an example of a rotational speed control table (correction values) which are used in controlling the rotational speed of the pressure roller 32 and stored in the storage section 66. This figure shows as an example a table for use in the control method (3) in which the quantity of heat applied to the pressure roller 32 is estimated simply based on the elapsed time since the reference time point.

The correction values shown in FIG. 6 are those for use in making the second rotational speed V2 greater than the first rotational speed V1. In this figure, the correction values are classified into those when the surface temperature of the pressure roller 32 detected by the roller temperature sensor 43 is 45° C. or below and those when the surface temperature thereof is 46° C. to 70° C. and each correction value is represented as a rate of speed increase relative to the first rotational speed V1. When the elapsed time since the reference time point is early, i.e., when the quantity of heat given to the pressure roller 32 is small (a first quantity of heat), the rate of speed increase is set higher than when a relatively long time has elapsed since the reference time point, i.e., when the quantity of heat given to the pressure roller 32 is relatively large (a second quantity of heat).

For example, when the above surface temperature is 45° C. or below, the rate of speed increase is 2.28% in the period from the reference time point to 60 seconds later and 0.74% in the period of 240 to 300 seconds after the reference time point. The reason for the rate of speed increase in the former period is that this period is a period shortly after the fixing unit 30 transitions from the outage state to the operating state and, therefore, the pressure roller 32 is not sufficiently heated to the core inside, resulting in insufficient degree of thermal expansion of the pressure roller 32. In order to compensate for a shortage of the outer diameter of the roller associated with the insufficient degree of thermal expansion, the rate of speed increase is set relatively large. On the other hand, the latter period is in a stage where a reasonably long time has elapsed since the reference time point and a reasonable, but still insufficient, quantity of heat has been given to the pressure roller 32. Therefore, because the degree of thermal expansion of the pressure roller 32 can be considered to reasonably progress, the rate of speed increase is set low. For the same reason, when the surface temperature of the pressure roller 32 at the reference time point is high (at 46° C. to 70° C.), the rate of speed increase is generally set low as compared to when the surface temperature at the reference time point is low (at 45° C. or below). When the surface temperature of the pressure roller 32 is above 70° C., the pressure roller 32 is considered to be thermally saturated. In this case, the first rotation control using the table shown in FIG. 6 is not applied but the second rotation control is performed from the reference time point.

In this embodiment, the period from the reference time point to 600 seconds later is set to a period for the first-stage control A1 of the first rotation control and the period of 600 seconds and later after the reference time point is set to a period for the second-stage control A2 of the first rotation control. In other words, when 600 seconds have elapsed since the reference time point, it is estimated that the specified quantity of heat has been given from the fixing roller 31 to the pressure roller 32. At this time point, the control method is changed from the first-stage control A1 to the second-stage control A2.

Figure 7:
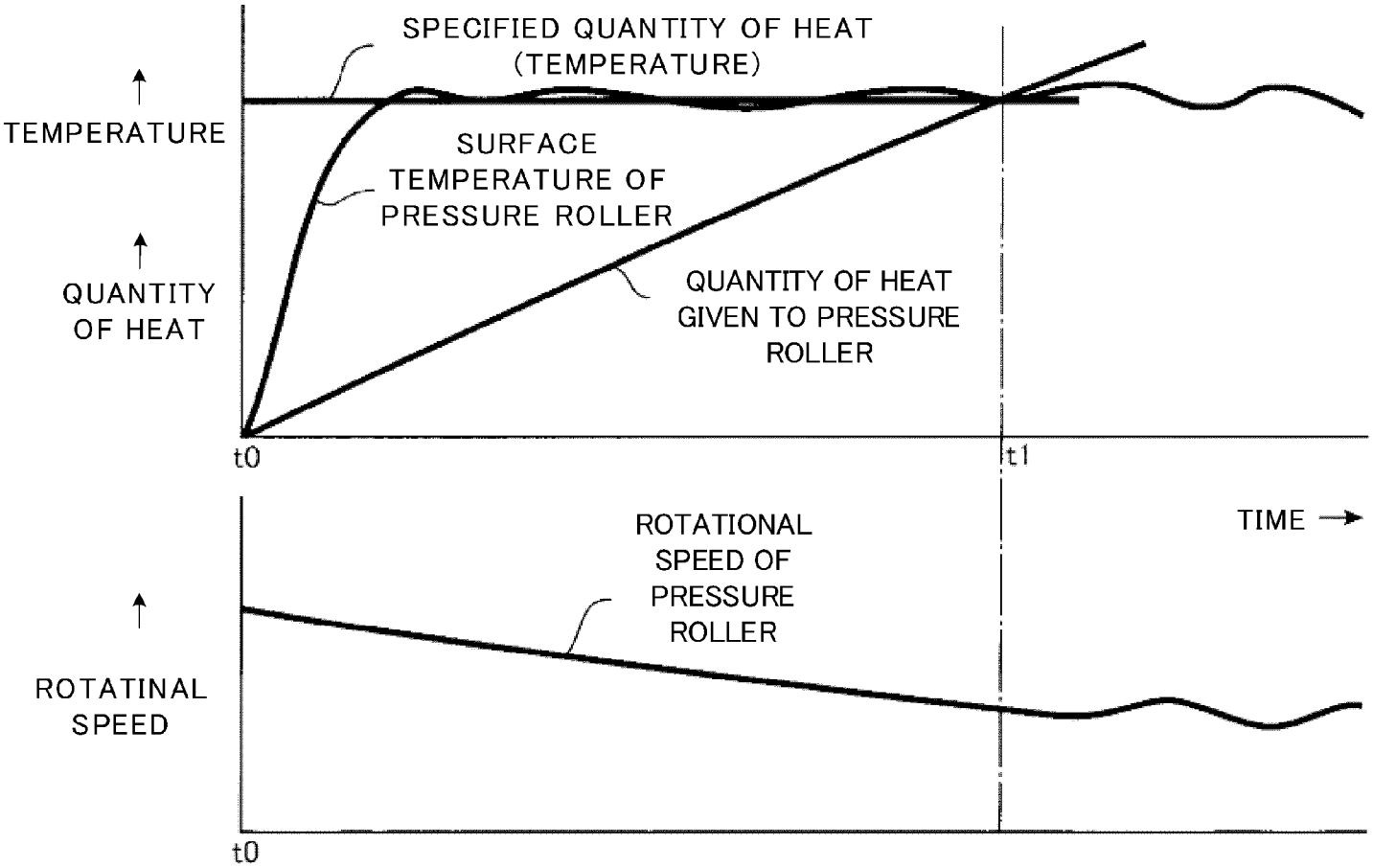
FIG. 7 is a graph showing the relation among the surface temperature of the pressure roller, the quantity of heat applied thereto, and the rotational speed thereof.

FIG. 7 is a graph showing the relation among the surface temperature of the pressure roller, the quantity of heat applied thereto, and the rotational speed thereof. As shown in FIG. 7, in the period from the time point t0 to the time point t1, the surface temperature of the pressure roller 32 relatively rapidly increases. However, as described previously, the quantity of heat given to the pressure roller 32 is small and the degree of thermal expansion thereof is insufficient. With time, the quantity of heat given to the pressure roller 32 increases and the thermal expansion progresses. Therefore, the second rotational speed V2 is set by correcting the first rotational speed V1 by the correction value showing a tendency to decrease the rate of speed increase with time since the reference time point. In other words, in the period from the time point t0 to the time point t1, the rotational speed of the pressure roller 32 gradually decreases. Hence, an appropriate second rotational speed V2 is set according to the degree of thermal expansion of the pressure roller 32.

The time point t1 is a time point when the specified quantity of heat can be assumed to have been given to the pressure roller 32. When the control method (1) (in which the aforementioned quantity of heat is determined based on the accumulated value of current applied to the coil 332) or the control method (2) (in which the aforementioned quantity of heat is determined based on the ON time of the heater 34) is adopted, the time point t1 is a time point when the quantity of heat obtained by calculation reaches the specified quantity of heat. After the time point t1, the pressure roller 32 is thermally saturated and, therefore, there is no need to increase the rotational speed thereof. Hence, after the time point t1, the pressure roller 32 is controlled to rotate at the first rotational speed V1 and the first rotational speed V1 is controlled by feedback based on the surface temperature of the pressure roller 32.

Referring back to FIG. 5, the motor control section 67 is configured to control the operation of the drive motor 5 to thus control the rotational speed of the pressure roller 32. Specifically, the motor control section 67 performs the aforementioned first rotation control based on the correction value in the rotational speed control table (FIG. 6) stored in the storage section 66 or performs the aforementioned second rotation control based on the temperature detected by the roller temperature sensor 43.

The speed correcting section 68 is configured to perform processing for correcting the correction value (rate of speed increase) of the rotational speed control table shown in FIG. 6 according to the situation of the surrounding environment of the fixing unit 30. FIG. 8 is an environment-dependent correction table used by the speed correcting section 68. The environment-dependent correction table is also previously stored in the storage section 66. This figure shows speed correction values to be added to the rate of speed increase shown in FIG. 6 when the ambient temperature and/or ambient humidity of the fixing unit 30 satisfies specified conditions. The ambient temperature and the ambient humidity are acquired by the measured value of the ambient temperature sensor 41 and the measured value of the ambient humidity sensor 42, respectively.

Specifically, in a low-temperature environment in which the ambient temperature is below 15° C. (a predetermined correction reference temperature), the speed correcting section 68 adds a speed correction value of "0.30%" to each rate of speed increase shown in FIG. 6. Thus, a correction is made to increase the second rotational speed V2. For example, when the surface temperature of the pressure roller 32 is below 45° C., the rate of speed increase in the period from the reference time point to 60 seconds later is 2.28%. However, when at that point the measured value of the ambient temperature sensor 41 is below 15° C., the speed correcting section 68 corrects the rate of speed increase to 2.28%+0.30%=2.58%. The rates of speed increase 60 seconds or later after the reference time point are also corrected in the same manner. The motor control section 67 performs the aforementioned first rotation control based on this corrected rate of speed increase.

Furthermore, in a high-humidity environment in which the ambient humidity is above 60% (a predetermined correction reference humidity), the speed correcting section 68 adds a speed correction value of "−0.30%" to each rate of speed increase shown in FIG. 6. Thus, a correction is made to decrease the second rotational speed V2. For example, when the surface temperature of the pressure roller 32 is below 45° C., the rate of speed increase in the period from the reference time point to 60 seconds later is 2.28%. However, when at that point the measured value of the ambient humidity sensor 42 is above 60%, the speed correcting section 68 corrects the rate of speed increase to 2.28%−0.30%=1.98%. The rates of speed increase 60 seconds or later after the reference time point are also corrected in the same manner. The motor control section 67 performs the aforementioned first rotation control based on this corrected rate of speed increase.

On the other hand, when the ambient temperature is 15° C. or above and the ambient humidity is 60% or below, the speed correcting section 68 does not correct the rate of speed increase. In other words, the speed correcting section 68 does not correct the second rotational speed V2 and maintains the second rotational speed V2 as it is. Furthermore, when the ambient temperature is below 15° C. and the ambient humidity is above 60%, the relevant speed correction rates are cancelled out by each other, so that the speed correcting section 68 eventually makes no correction of the rate of speed increase.

Figure 9A:
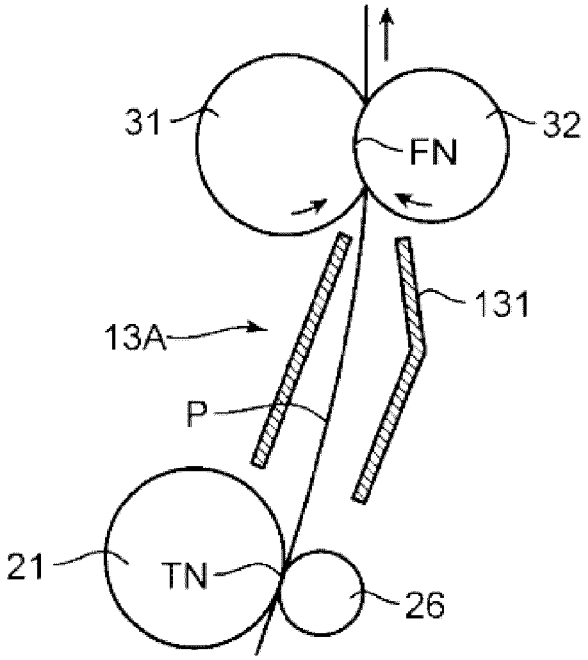
FIGS. 9A and 9B are schematic views showing the respective manners of sheet conveyance at low temperature and at high humidity, respectively.
Figure 9B:
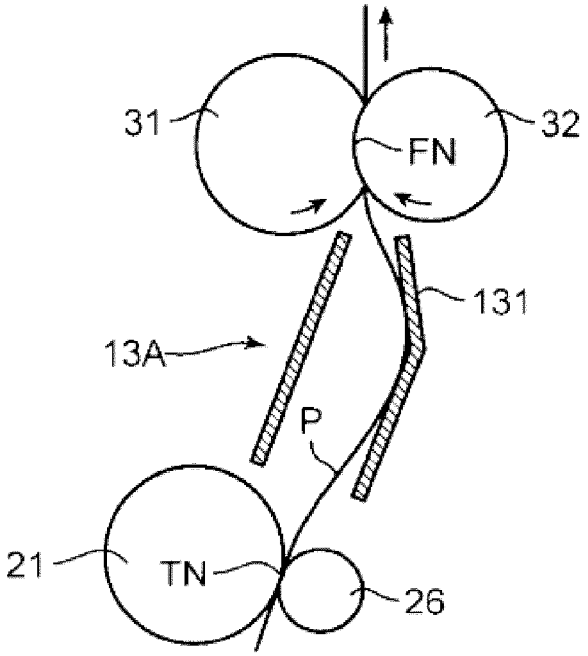

A description will be given of the reasons for the correction of the rate of speed increase according to the situation of the surrounding environment of the fixing unit 30 with reference to FIGS. 9A and 9B. FIGS. 9A and 9B are schematic views showing the respective manners of sheet conveyance at low temperature and at high humidity, respectively. In low-temperature environments, the electrical resistance of the sheets P and the dielectric constant of air decrease. Therefore, if the sheet P having an unfixed toner image transferred thereto in the image forming unit 20 is passed positively along a conveyance guide 131 of the sheet conveyance path 13A located upstream of the fixing nip FN, electrostatic toner scattering (toner scattering) will be likely to occur because of a potential difference between the sheet P and the conveyance guide 131.

To cope with this, in low-temperature environments of below the correction reference temperature (15° C.), a correction is made to increase the second rotational speed V2. Thus, as shown in FIG. 9A, the sheet P is somewhat tensioned with a conveyance force of the fixing nip FN. The sag of the sheet P between the fixing nip FN and the transfer nip TN can be reduced, so that the sheet P keeps a distance from the conveyance guide 131. Therefore, the occurrence of toner scattering can be prevented.

In high-humidity environments, the sheets deteriorate the rigidity and are thus likely to warp and wrinkle. Therefore, the sheet conveyed along the sheet conveyance path 13A will be likely to warp and wrinkle, which may make it easy to cause image defects.

To cope with this, in high-humidity environments of above the correction reference humidity (60%), a correction is made to decrease the second rotational speed V2. Thus, as shown in FIG. 9B, the sheet conveyance of the fixing nip FN is somewhat delayed relative to the sheet conveyance of the transfer nip TN. Therefore, the sag of the sheet P between the fixing nip FN and the transfer nip TN is increased, so that the sheet P is conveyed to lean against the conveyance guide 131. Thus, even if the sheet P being conveyed warps, this can be absorbed by the sag of the sheet P. Hence, the occurrence of image defects can be prevented.

Next, a description will be given of the control operation of the control section 6 with reference to the flowcharts shown in FIGS. 10 and 11. The control section 6 stands by until the mode changing section 62 sets a specific operation mode (step S1). Specifically, the functional part of the control section 6 involved in the control over the speed of the pressure roller 32 stands by until there occurs a mode change in which the fixing unit 30 transitions from an outage state to an operating state, more specifically, until the power switch 102 is turned from OFF to ON so that the image formation mode is set or until the apparatus is returned from the sleep mode or troubleshooting mode to the image formation mode. The timing of the setting or return to the image formation mode is the reference time point for the speed control.

If the setting or return to the image formation mode occurs (YES in step S1), the control mode setting section 65 acquires data on the surface temperature of the pressure roller 32 from the roller temperature sensor 43 (step S2). Subsequently, the control mode setting section 65 determines whether or not the above surface temperature is the predetermined reference temperature (70° C. in the above embodiment) or below (step S3). If the above surface temperature is the reference temperature or below (YES in step S3), this means that the pressure roller 32 is not given a sufficient quantity of heat. Therefore, the motor control section 67 performs the aforementioned first rotation control (first-stage control A1) (step S4).

While the first rotation control (first-stage control A1) is performed, the heat quantity detecting section 64 determines whether or not the quantity of heat given to the pressure roller 32 since the reference time point has reached the predetermined specified quantity of heat (step S5). If the specified quantity of heat is not reached (NO in step S5), the first rotation control (first-stage control A1) is continued. On the other hand, if the specified quantity of heat is reached (YES in step 5), the motor control section 67 performs the aforementioned second rotation control (the second-stage control A2 of the first rotation control) (step S6). If the surface temperature of the pressure roller 32 is above the reference temperature (NO in step S3), the second rotation control is performed from the reference time point (step S6).

In the second rotation control, the motor control section 67 performs a feedback control in which the first rotational speed V1 is finely adjusted based on the temperature detected by the roller temperature sensor 43 so that the predetermined sheet conveyance speed can be maintained. Because this feedback control is a widely used control method, a detailed explanation thereof using a flowchart will be omitted here. While step S6 is performed, it is determined whether or not the image formation mode is terminated (step S7). If the mode changing section 62 changes the operation mode from the image formation mode to another mode (for example, the sleep mode or the troubleshooting mode) or the power switch 102 is turned OFF (YES in step S7), the control section 6 ends the processing.

Figure 10:
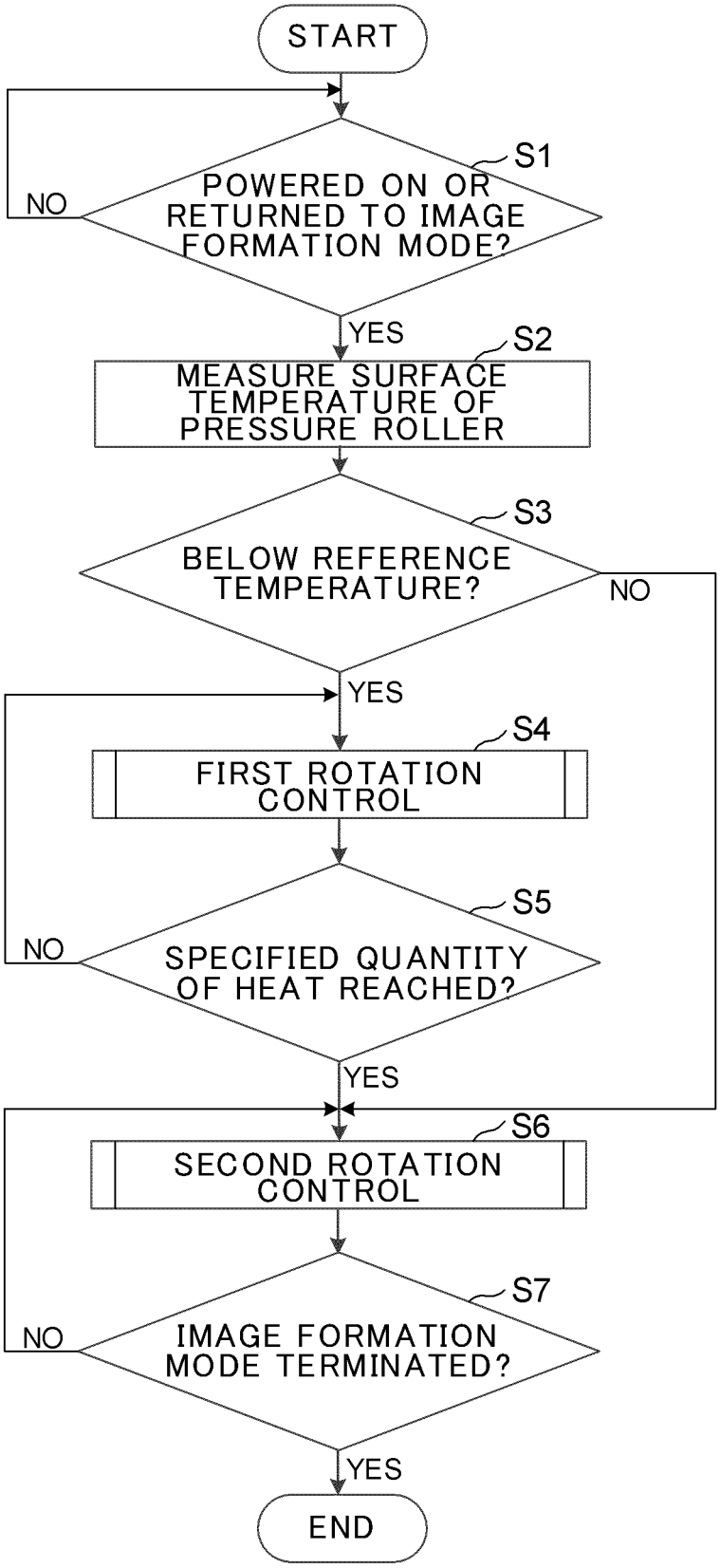
FIG. 10 is a flowchart showing an operation of the image forming apparatus.
Figure 11:
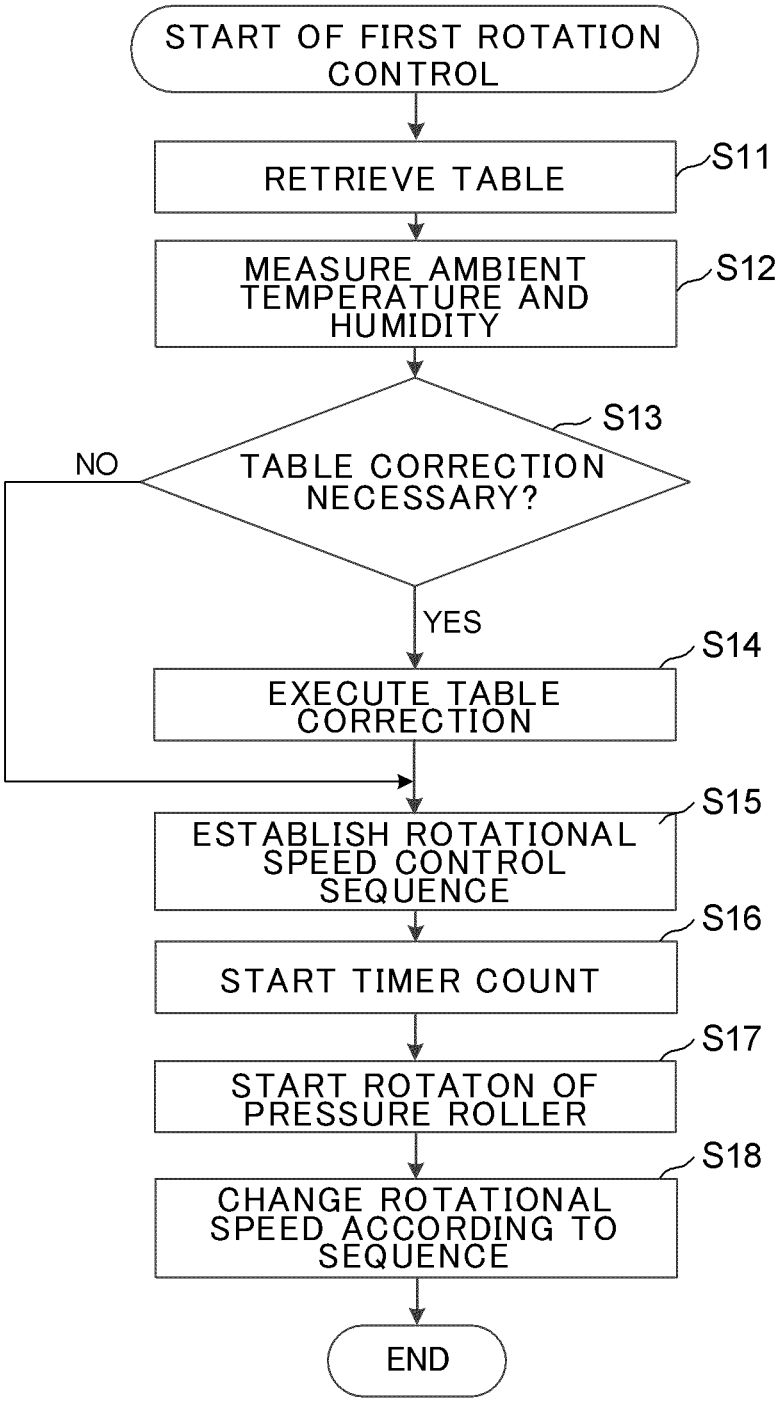
FIG. 11 is a flowchart showing an operation of the image forming apparatus.

FIG. 11 is a flowchart showing the details of the first rotation control (first-stage control A1) in step S4 shown in FIG. 10. This figure shows a flowchart for the control method (3) in which the quantity of heat applied to the pressure roller 32 is estimated simply based on the elapsed time since the reference time point.

The motor control section 67 accesses the storage section 66 to retrieve therefrom the rotational speed control table shown in FIG. 6 (step S11). Furthermore, the speed correcting section 68 acquires data on the ambient temperature from the ambient temperature sensor 41 and acquires data on the ambient humidity from the ambient humidity sensor 42 (step S12).

Subsequently, in step S13, the speed correcting section 68 makes a comparison between the acquired ambient temperature and the predetermined specified reference temperature (15° C.) and a comparison between the acquired ambient humidity and the predetermined specified reference humidity (60%) and determines whether or not it is necessary to correct the rate of speed increase in the rotational speed control table retrieved in step S11. In a low-temperature environment where the ambient temperature is below 15° C., the speed correcting section 68, in step S14, corrects the rate of speed increase in the rotational speed control table to increase the second rotational speed V2. On the other hand, in a high-humidity environment where the ambient humidity is above 60%, the speed correcting section 68, in step S14, corrects the rate of speed increase to decrease the second rotational speed V2. If the surrounding environment applies neither to the above low-temperature environment nor to the above high-humidity environment (NO in step S13), step S14 is skipped. Through these steps of processing, it is established in what sequence during the first rotation control (first-stage control A1) the motor control section 67 controls the rotational speed of the pressure roller 32 (step S15).

In parallel with the above processing, the timer 63 starts the count of the elapsed time since the reference time point (step S16). In this embodiment, the control method is adopted in which the quantity of heat applied to the pressure roller 32 is estimated based on the elapsed time since the reference time point. Therefore, the count start of the timer 63 is linked to the aforementioned determination of the specified quantity of heat performed by the heat quantity detecting section 64 in step S5. In other words, the heat quantity detecting section 64 makes, based on the count value of the elapsed time since the reference time point, a determination (step S5) of whether or not the specified quantity of heat is reached.

Thereafter, the motor control section 67 activates the drive motor 5 to start the rotational drive of the pressure roller 32 (step S17). Then, according to the sequence established in step S15, the motor control section 67 changes the rotational speed of the pressure roller 32 with time (step S18).

As thus far described, in the fixing unit 30 and the image forming apparatus 1 according to above embodiment, the heat quantity detecting section 64 of the control section 6 determines the quantity of heat given from the fixing roller 31 to the pressure roller 32. Therefore, it is possible to, based on the above quantity of heat, know not the local temperature condition, such as the surface temperature of the pressure roller 32, but in what temperature condition the whole of the pressure roller 32 actually is. Until the quantity of heat given to the pressure roller 32 reaches the specified quantity of heat, the motor control section 67 rotates the pressure roller 32 at the second rotational speed V2 obtained by correcting the first rotational speed V1 according to the acquired quantity of heat. Therefore, the conveyance speed of the sheet passing through the fixing nip FN can be set depending upon the actual temperature condition of the pressure roller 32, i.e., in consideration of the degree of thermal expansion of the pressure roller 32 or changes in coefficient of friction at the fixing nip FN. Hence, variations in the sheet conveyance speed in the fixing unit 30 can be reduced as much as possible, providing the formation of an image of good quality.

In a general fixing device, the quantity of thermal expansion of the pressure roller is estimated from, for example, the surface temperature of the pressure roller and the rotational driving speed of the pressure roller is adjusted based on the estimated quantity of thermal expansion. However, the surface temperature of the roller does not always agree with the temperature around the roller core. For example, just after the image forming apparatus transitions from an off state to an operating state, there may be a case where even if the temperature sensor detects that the surface temperature of the roller reaches a temperature sufficient for fixation processing, the roller core and its vicinity have not reached the temperature. In other words, there may be a case where the temperature detected by the temperature sensor does not agree with the actual degree of thermal expansion of the pressure roller. In this case, there arises a problem of failure to control the sheet conveyance speed by feedback as expected.

This problem can be solved by the above embodiment of the present disclosure. Specifically, as described above, the above embodiment of the present disclosure can reduce variations in the sheet conveyance speed in the fixing device as much as possible.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A fixing device configured to fix a toner image on a sheet, the fixing device comprising:

a heat rotor equipped with a heat source;

a pressure rotor pressed against the heat rotor to form a fixing nip and expandable by heat given from the heat rotor;

a drive section configured to drive the pressure rotor into rotation;

a control section configured to control the drive section and thus control a rotational speed of the pressure rotor; and a heat quantity detecting section configured to determine a quantity of heat given from the heat rotor to the pressure rotor, wherein the control section is configured to perform a first rotation control so that after the heat quantity detecting section detects that a predetermined specified quantity of heat has been given from the heat rotor to the pressure rotor since a reference time point when the fixing device has transitioned from an outage state to an operating state, the control section allows the pressure rotor to rotate at a predetermined first rotational speed and that before the heat quantity detecting section detects that the specified quantity of heat has been given to the pressure rotor, the control section allows the pressure rotor to rotate at a second rotational speed obtained by correcting the first rotational speed according to the quantity of heat determined by the heat quantity detecting section, the fixing device further comprises a storage section configured to store correction values for use in obtaining the second rotational speed, the control section is configured to perform the first rotation control based on the correction value in the storage section, the correction value is a correction value for making the second rotational speed greater than the first rotational speed, and a rate of speed increase when the quantity of heat is a first quantity of heat is higher than a rate of speed increase when the quantity of heat is a second quantity of heat larger than the first quantity of heat.

2. An image forming apparatus comprising:

an image forming section configured to transfer a toner image to a sheet; and the fixing device according to claim 1.

3. A fixing device configured to fix a toner image on a sheet, the fixing device comprising:

a heat rotor equipped with a heat source;

a pressure rotor pressed against the heat rotor to form a fixing nip and expandable by heat given from the heat rotor;

a drive section configured to drive the pressure rotor into rotation;

a control section configured to control the drive section and thus control a rotational speed of the pressure rotor; and a heat quantity detecting section configured to determine a quantity of heat given from the heat rotor to the pressure rotor, wherein the control section is configured to perform a first rotation control so that after the heat quantity detecting section detects that a predetermined specified quantity of heat has been given from the heat rotor to the pressure rotor since a reference time point when the fixing device has transitioned from an outage state to an operating state, the control section allows the pressure rotor to rotate at a predetermined first rotational speed and that before the heat quantity detecting section detects that the specified quantity of heat has been given to the pressure rotor, the control section allows the pressure rotor to rotate at a second rotational speed obtained by correcting the first rotational speed according to the quantity of heat determined by the heat quantity detecting section, the heat rotor is a fixing belt supported by a support roller and includes as the heat source an IH heater configured to heat the fixing belt by induction, and the heat quantity detecting section is configured to determine the quantity of heat based on the sum of current applied to operate the IH heater since the reference time point.

4. A fixing device configured to fix a toner image on a sheet, the fixing device comprising:

a heat rotor equipped with a heat source;

a pressure rotor pressed against the heat rotor to form a fixing nip and expandable by heat given from the heat rotor;

a drive section configured to drive the pressure rotor into rotation;

a control section configured to control the drive section and thus control a rotational speed of the pressure rotor; and a heat quantity detecting section configured to determine a quantity of heat given from the heat rotor to the pressure rotor, wherein the control section is configured to perform a first rotation control so that after the heat quantity detecting section detects that a predetermined specified quantity of heat has been given from the heat rotor to the pressure rotor since a reference time point when the fixing device has transitioned from an outage state to an operating state, the control section allows the pressure rotor to rotate at a predetermined first rotational speed and that before the heat quantity detecting section detects that the specified quantity of heat has been given to the pressure rotor, the control section allows the pressure rotor to rotate at a second rotational speed obtained by correcting the first rotational speed according to the quantity of heat determined by the heat quantity detecting section, the fixing device further comprises a first temperature sensor configured to measure a surface temperature of the pressure rotor, the control section performs the first rotation control when at the reference time point the first temperature sensor detects a temperature below a predetermined reference temperature, and the control section performs, when at the reference time point the first temperature sensor detects a temperature above the predetermined reference temperature, a second rotation control for controlling the rotational speed of the pressure rotor based on the temperature detected by the first temperature sensor.

* * * * *